US006789370B2

(12) United States Patent
Spatafora

(10) Patent No.: US 6,789,370 B2
(45) Date of Patent: Sep. 14, 2004

(54) CIGARETTE PACKING MACHINE

(75) Inventor: Mario Spatafora, Bologna (IT)

(73) Assignee: G.D Societa' Per Azioni, Bolgna (IT)

( * ) Notice: Subject to any disclaimer, the term of this patent is extended or adjusted under 35 U.S.C. 154(b) by 0 days.

(21) Appl. No.: 10/320,289

(22) Filed: Dec. 16, 2002

(65) Prior Publication Data

US 2003/0140597 A1 Jul. 31, 2003

(30) Foreign Application Priority Data

Dec. 18, 2001 (IT) ..... BO2001A0766
Jan. 22, 2002 (IT) ..... BO2002A0026

(51) Int. Cl.[7] ..... B65B 11/28; B65B 19/22
(52) U.S. Cl. ..... 53/234; 493/151
(58) Field of Search ..... 53/228–234; 493/151

(56) References Cited

U.S. PATENT DOCUMENTS 3,977,157 A * 8/1976 Davies et al. ..... 53/234
4,085,568 A 4/1978 Focke et al.
4,208,854 A * 6/1980 Seragnoli ..... 53/234
4,308,708 A * 1/1982 Focke ..... 53/232
4,392,338 A * 7/1983 Fox ..... 53/462
4,559,758 A * 12/1985 Gamberini ..... 53/234
4,596,112 A * 6/1986 Buckley et al. ..... 53/234
4,947,617 A * 8/1990 Focke et al. ..... 53/234
4,979,349 A 12/1990 Focke
5,129,209 A * 7/1992 Focke ..... 53/234
5,301,489 A * 4/1994 Benedetti ..... 53/234
6,038,832 A 3/2000 Focke et al.

FOREIGN PATENT DOCUMENTS

DE 24 39 192 3/1976
DE 19852693 5/2000
EP 0 554 753 8/1993
EP 0913328 A2 * 5/1999 ..... B65B/19/20
EP 0 940 340 9/1999

* cited by examiner

*Primary Examiner*—Stephen F. Gerrity
(74) *Attorney, Agent, or Firm*—Marshall, Gerstein & Borun LLP

(57) ABSTRACT

A cigarette packing machine wherein an output wheel advances a number of gripping heads, each for receiving, at an input station, a respective packet with its longitudinal axis crosswise to the travelling direction of the gripping heads, and with outer longitudinal tabs open, detached from respective inner longitudinal tabs, and supported on respective folding wings carried by the relative gripping head; the output wheel feeds the packet through a gumming station, where gum is applied between each outer longitudinal tab and the relative inner longitudinal tab, and moves the relative folding wings to fold each outer longitudinal tab into a closed position contacting the relative inner longitudinal tab before the closed packet is fed to an output station (FIG. 2).

19 Claims, 5 Drawing Sheets

3
5
20
21
19
4
6
35
40
39
38
36
37
34
33
32
29
31
28
44
45
30
43
24
25
42
41
27
26
23

1
2
3
4
5
6
7
8
9
10
11
12
13
14
15
16
17
19
21
22
24
25
35
36
37
44
45
46
47
48
49
50
51
52
53
54
55
57
58
61
62
63
67
68
70
71
72

CIGARETTE PACKING MACHINE

BACKGROUND OF THE INVENTION

More specifically, the present invention relates to a cigarette packing machine (e.g., as disclosed in U.S. Pat. No. 4,979,349) comprising an output wheel, in turn comprising an input station and an output station. The output wheel rotates about a respective axis to feed a number of gripping heads in a given traveling direction and along a given path through the input and the output stations. Each gripping head is engaged by a respective packet of cigarettes having a longitudinal axis and longitudinal minor lateral walls, each of which is defined by a respective outer longitudinal tab and a respective inner longitudinal tab. The output wheel receives each packet at the input station with the relative outer longitudinal tabs in an open position. Each gripping head comprises folding means for folding, at the input station each outer longitudinal tab into a closed position contacting the relative inner longitudinal tab. The folding means are also designed to grip the packets so as to avoid each packet to fall out of the respective gripping head along the given path.

The packing machines of the type described above, require that the longitudinal tabs are properly folded before the packet is fed along the given path and that all working actions (e.g., gumming), that have to be performed on the inner side of the outer longitudinal tab and/or the outer side of the inner longitudinal tab, have to be completed at the input station.

Such a solution has proved inadequate since it determines a decrease in the production speed and the need of placing further working devices in the area of the already relatively bulky input station.

SUMMARY OF THE INVENTION

It is an object of the present invention to provide a packing machine designed to eliminate the aforementioned drawbacks.

BRIEF DESCRIPTION OF THE DRAWINGS

A number of nonlimiting embodiments of the present invention will be described by way of example with reference to the accompanying drawings, in which.

DETAILED DESCRIPTION OF THE INVENTION

Figure 1:
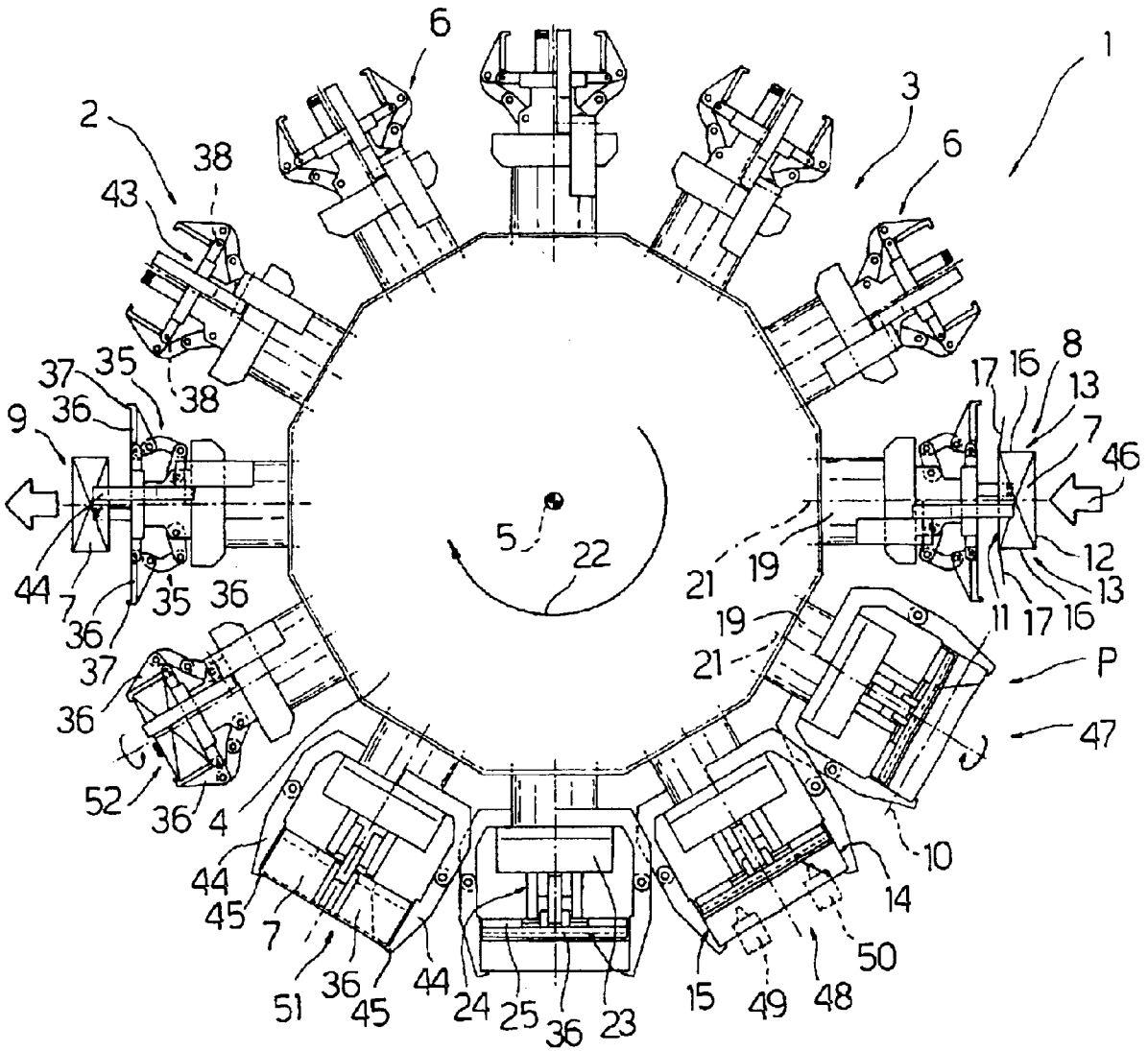
FIG. 1 shows a schematic side view of an output portion of a first preferred embodiment of the packing machine according to the present invention.

Number 1 in FIG. 1 indicates as a whole a cigarette packing machine, an output portion 2 of which comprises an output wheel 3 in turn comprising a powered central disk 4 rotating continuously (clockwise in FIG. 1) about a respective central axis 5. Output wheel 3 also comprises a number of gripping heads 6 equally spaced along the periphery of central disk 4 and for receiving respective packets 7 of cigarettes, still partly open, at an input station 8, feeding respective packets 7 along a circular path P to an output station 9, for closing respective packets 7 as they travel along path P.

Figure 2:
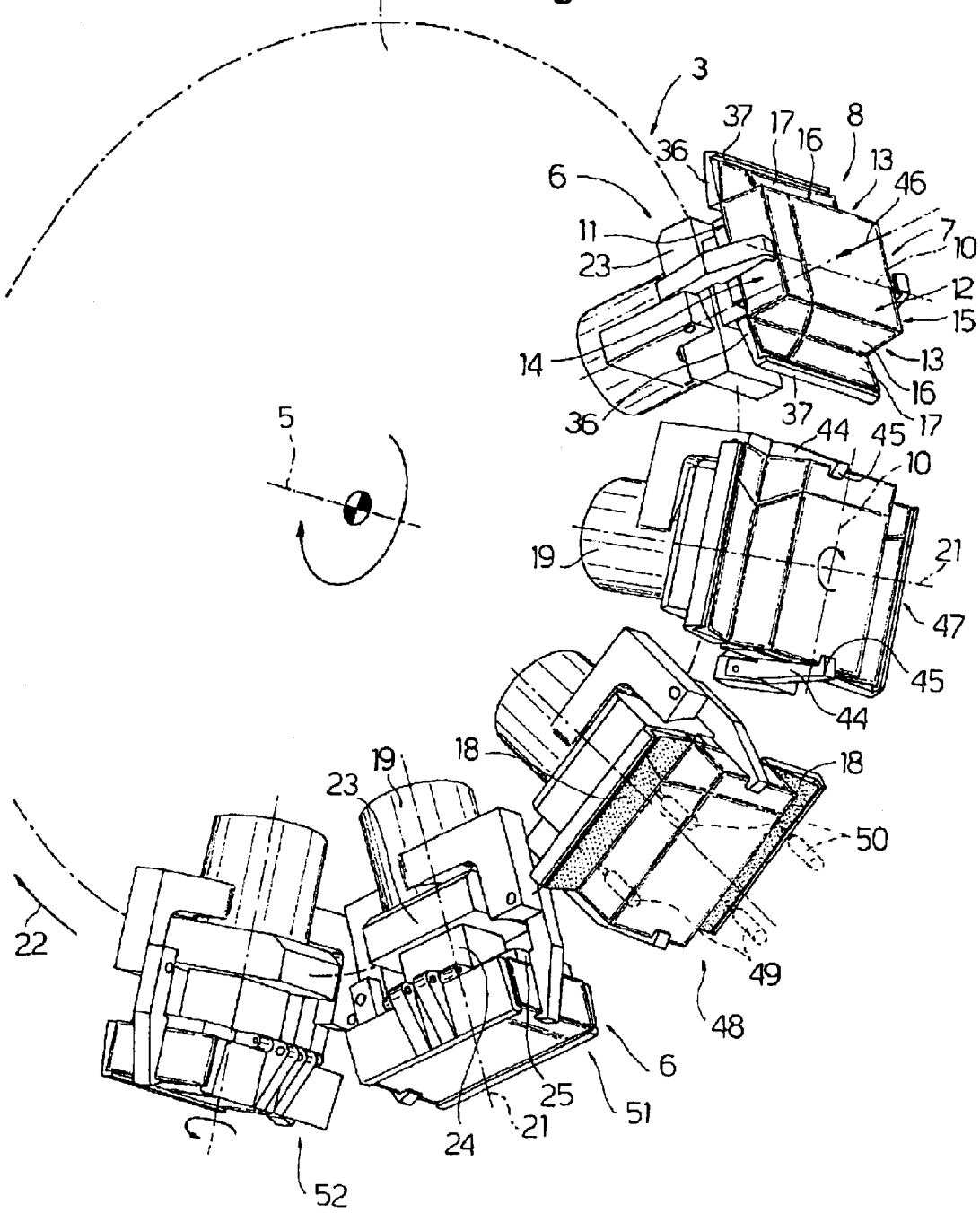
FIG. 2 shows a larger-scale view in perspective of a detail in FIG. 1.
Figure 3:
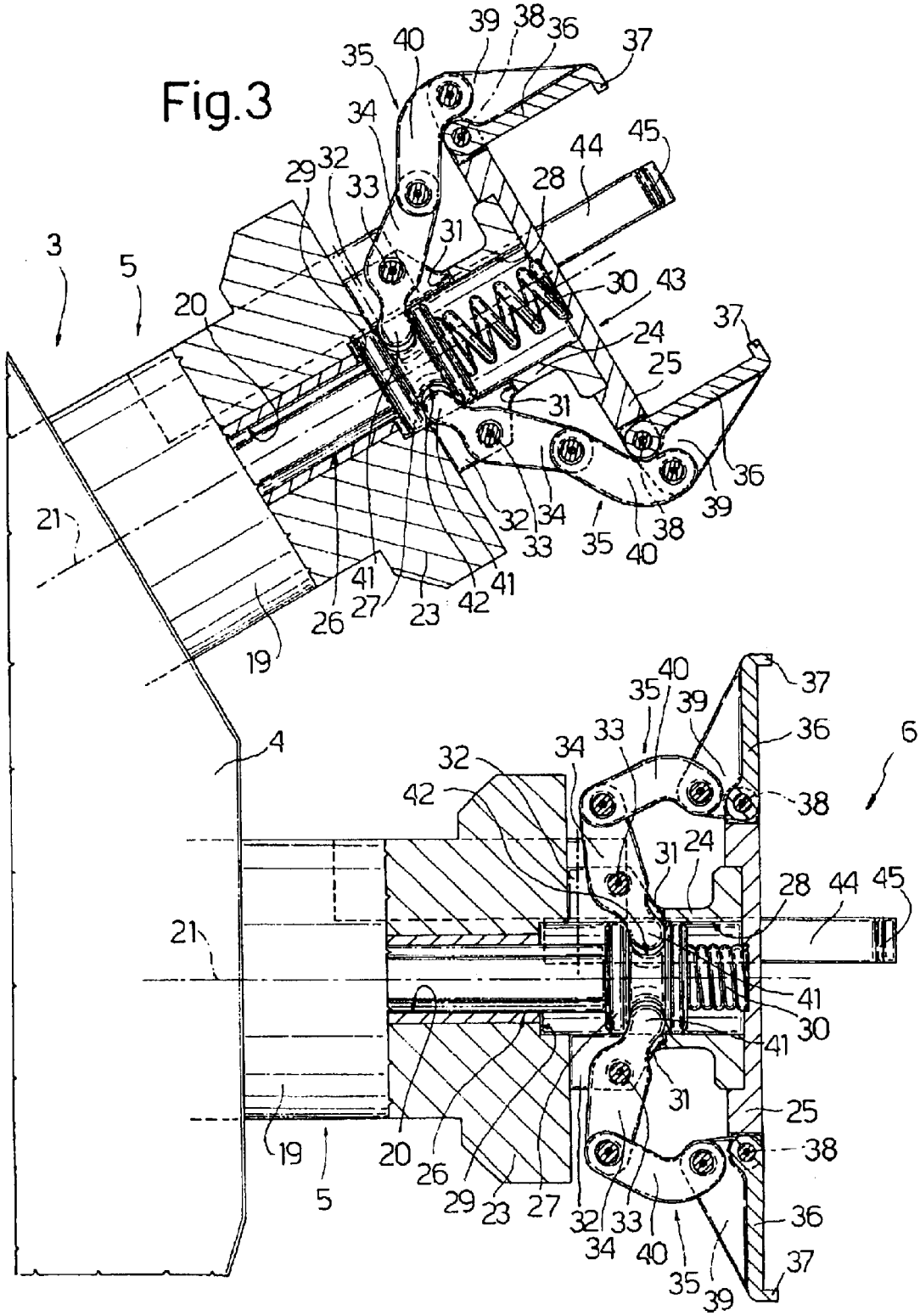
FIG. 3 shows a schematic longitudinal section, with parts removed for clarity, of a detail in FIGS. 1 and 2.

With reference to FIGS. 2 and 3, each packet 7 is a rigid, hinged-lid packet substantially in the form of a rectangular parallelepiped and having a longitudinal axis 10; a front major lateral wall 11 and rear major lateral wall 12 parallel to each other and to longitudinal axis 10; two minor lateral walls 13 parallel to each other and to longitudinal axis 10, and perpendicular to major lateral walls 11 and 12; and two end walls 14 and 15. Each minor lateral wall 13 is defined by an inner longitudinal tab 16 connected to a relative lateral edge of rear major lateral wall 12, and by an outer longitudinal tab 17 connected to a relative lateral edge of front major lateral wall 11. Tabs 16 and 17 are superimposed and gummed to each other by the interposition of a layer of gum 18, which may be defined by hot gum, cold gum, or, as in the example shown, both hot and cold gum.

As shown more clearly in FIG. 3, each gripping head 6 comprises a tubular shaft 19, which connects relative gripping head 6 to central disk 4 and has a central hole 20 coaxial with a respective axis 21 extending radially with respect to axis 5 and perpendicular to the travelling direction 22 of gripping head 6. Each tubular shaft 19 is fitted integrally at the outer end with a substantially rectangular end plate 23, through which extends central hole 20, and is fitted to central disk 4 of output wheel 3 to oscillate 90°, with respect to central disk 4 and about respective axis 21, under the control of a known cam device (not shown) fitted inside central disk 4.

A further tubular shaft 24 projects outwards from end plate 23, is coaxial with relative axis 21, and is closed at the outer end by a substantially rectangular plate 25 parallel to end plate 23. A piston 26 is fitted in sliding and angularly-fixed manner inside tubular shafts 19 and 24, is activated by a known cam actuating device (not shown) housed inside central disk 4, and comprises, on the outward-facing end, a head 27 mounted to slide inside an axial hole 28 of tubular shaft 24, and which is normally maintained contacting an inner shoulder 29 of tubular shaft 19 by a spring 30 coaxial with axis 21 and compressed between plate 25 and head 27.

Two diametrically opposite, longitudinal slits are formed through tubular shaft 24, each of which extends between the arms of a relative fork 32 fitted externally to tubular shaft 24 to support a relative pin 33 crosswise to relative axis 21 and defining the pivot of a respective rocker arm 34. Each rocker arm 34 controls a respective articulated quadrilateral 35 controlling the angular position of a respective wing 36, which has an end tooth 37 facing the other wing 36, and is hinged to a lateral edge of plate 25 to rotate-under the control of relative articulated quadrilateral 35, with respect to plate 25, and about a respective axis 38 parallel to relative pin 33—between a normal closed position (at the top in FIG. 3) in which wing 36 is perpendicular to plate 25, and an open position (at the bottom in FIG. 3) in which wing 36 is substantially coplanar with plate 25.

Each articulated quadrilateral 35 comprises a first crank 39 integral with relative wing 36; a connecting rod 40; and a second crank defined by a first arm of relative rocker arm 34, a second arm of which is fitted on the end with a tappet 41 engaging in transversely sliding manner an annular groove 42 formed in the outer surface of head 27. In the closed position, wings 36 and respective end teeth 37 define, together with relative plate 25, a seat 43 for receiving and retaining a relative packet 7 positioned with its longitudinal axis 10 parallel to axes 38, and with front major lateral wall 11 contacting plate 25.

Two diametrically opposite jaws 44 are hinged to the outside of tubular shaft 19, each of which has a transverse end tooth 45, and is rotated, by a known actuating device (not shown) carried by central disk 4, between an open position and a closed position closing the ends of relative seat 43 in a plane parallel to axes 38 and perpendicular to the plane of end plate 23.

In actual use, gripping heads 6 are fed successively to input station 8 in the closed position, with axes 38 crosswise to travelling direction 22, and with relative pairs of jaws 44 in the open position.

In the following description, reference is made to one gripping head 6, and as of the instant in which gripping head 6 reaches a position immediately upstream from input station 8.

At this point, piston 26, formerly in a withdrawn rest position, is moved into an extracted work position in which it rotates wings 36 outwards about respective axes 38 and in opposition to spring 30. Immediately afterwards, gripping head 6 receives relative packet 7, which, as shown more clearly in FIG. 2, is fed to input station 8 in a substantially radial feed direction 46 with respect to output wheel 3, with its front major lateral wall 11 facing seat 43, with outer longitudinal tabs 17 in the open position, and with longitudinal axis 10 crosswise to travelling direction 22.

As front major lateral wall 11 of packet 7 contacts plate 25, and outer longitudinal tabs 17 contact relative wings 36 maintained in the open position, jaws 44 are closed to engage the ends of packet 7 and hold packet 7 on plate 25 by means of teeth 45.

As shown in FIGS. 1 and 2, on leaving input station 8, gripping head 6 and relative packet 7 move on to a first turn-around station 47 where tubular shaft 19 is rotated 90° about axis 21, thus also rotating plate 25 through 90° about axis 21, so that axes 38 are eventually positioned longitudinally, i.e., parallel to travelling direction 22.

Immediately afterwards, gripping head 6 and relative packet 7 are fed through a gumming station 48 where two hot gumming devices 49, located in fixed positions on opposite sides of path P, and two cold gumming devices 50, also located in fixed positions on opposite sides of path P, deposit spots of hot gum and cold gum respectively to form layer of gum 18 on the inner surface of each of outer longitudinal tabs 17, still in the open position on relative wings 36. Wings 36 are maintained in the open position by piston 26 in the extracted work position, and are moved into the closed position by moving piston 26 into the withdrawn rest position at a folding station 51 immediately downstream from gumming station 48.

In variations not shown, only hot gumming devices 49 or cold gumming devices 50 are used at gumming station 48.

As they close, wings 36 on the one hand complete closure of packet 7, and, on the other, secure packet 7 firmly to gripping head 6 by teeth 37 of wings 36 engaging rear major lateral wall 12 of packet 7 to hold packet 7 on plate 25.

At this point, packet 7 is fed by gripping head 6 through a further turn-around station 52 where tubular shaft 19 is again rotated 90° about relative axis 21 to restore packet 7 to its original position crosswise to travelling direction 22.

In a variation not shown, turn-around station 52 is dispensed with, and packet 7 is fed to output station 9 with its longitudinal axis 10 parallel to travelling direction 22, and is restored to its original position downstream from output station 9.

When packet 7 reaches output station 9, both jaws 44 and wings 36 are moved into the open position to release packet 7 onto a known further conveyor not shown.

In a further variation not shown, gumming station 48 is located upstream from input station 8.

Figure 4:
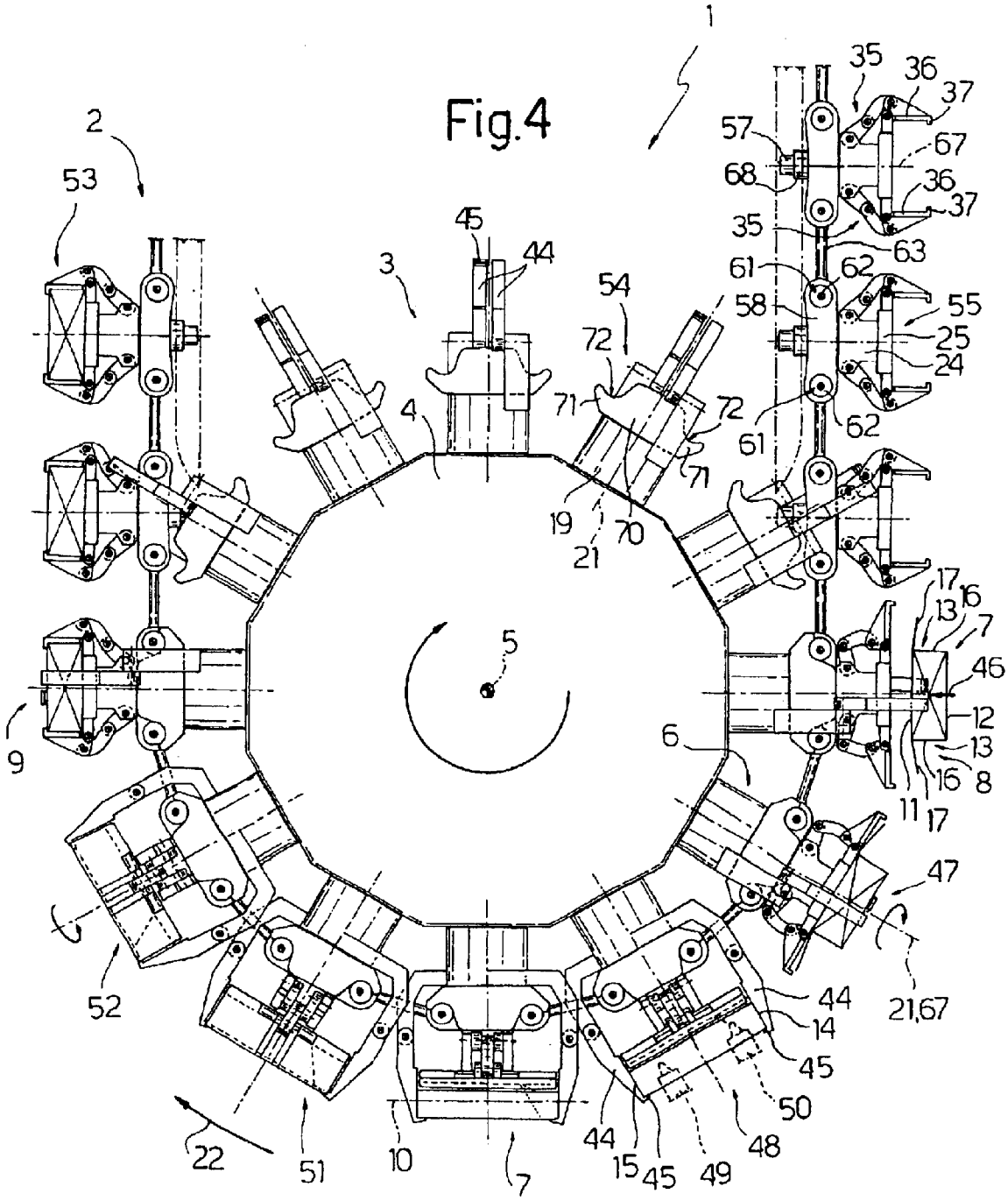
FIG. 4 shows a schematic side view of an output portion of a second preferred embodiment of the packing machine according to the present invention.
Figure 5:
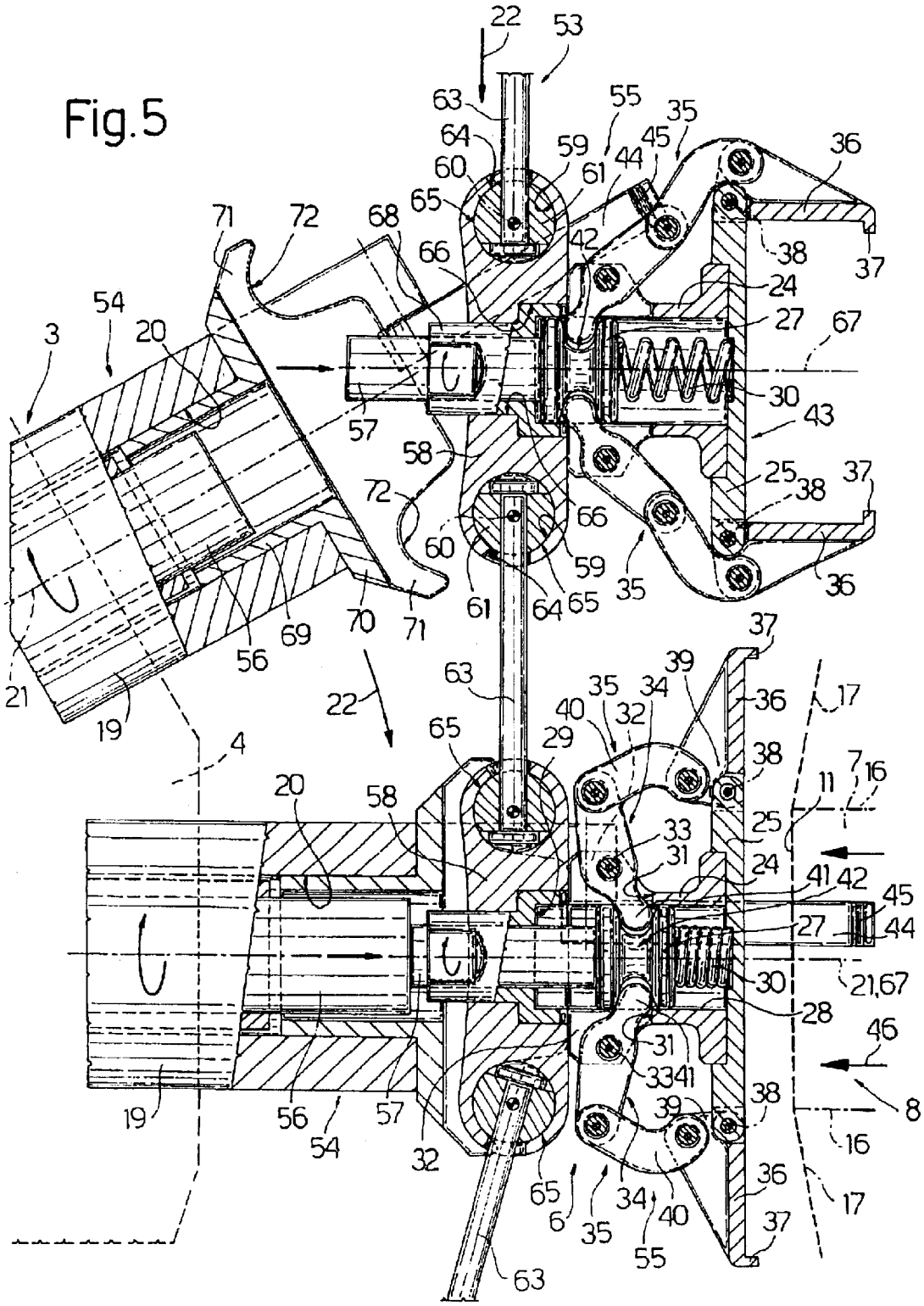
FIG. 5 shows a schematic longitudinal section, with parts removed for clarity, of a detail in FIG. 4.

In the embodiment shown in FIGS. 4 and 5, the aforementioned further conveyor is a conveyor 53, preferably a drying conveyor, which extends about central disk 4 of output wheel 3, by which it is driven, and is tangent to output wheel 3 along path P between input station 8 and output station 9.

In this case, each gripping head 6 described above is divided into two parts, a first defined by a supporting unit 54 carried by central disk 4 and coaxial with a respective axis 21, and a second defined by a gripping unit 55 carried by conveyor 53 and only defining, together with a relative supporting unit 54, a relative gripping head 6 when gripping unit 55 travels along path P together with relative supporting unit 54. For which purpose, gripping units 55 are equally spaced along conveyor 53 with the same spacing as supporting units 54 about central disk 4, and are fed to input station 8 in time with respective supporting units 54.

In this case, piston 26 is also divided into two parts, and comprises a first rod 56 mounted to slide inside tubular shaft 19, and a second rod 57 supporting head 27 and mounted to slide on gripping unit 55.

More specifically, as shown in FIG. 5, each gripping unit 55 comprises a substantially flat, substantially rectangular base plate 58 having, at each end, a cylindrical through hole 59, the axis 60 of which is parallel to the plane of base plate 58 and perpendicular to the travelling direction 22 of conveyor 53. A cylindrical pin 61 is fitted in rotary manner inside each hole 59, is coaxial with relative axis 60, and has two opposite end portions 62 projecting from relative hole 59. To a central portion of each pin 61 is connected in rotary manner one end of a respective rod 63, which extends crosswise to axis 60 of relative pin 61, and penetrates relative hole 59 through a slot 64 formed in base plate 58 and crosswise to axis 60 of relative hole 59. The other end of rod 63 is connected as described above to a pin 61 of an adjacent gripping unit 55 so as to be connected to the two adjacent gripping units 55 by two hinges 65, each defined by a relative pin 61, by a relative hole 59, and by the rotary connection between the relative end of rod 63 and relative pin 61.

Base plate 58 has a central through hole 66 having an axis 67 perpendicular to the plane of base plate 58, to relative axes 60, and to travelling direction 22, and engaged in rotary and axially-fixed manner by a tubular axial appendix 68 of tubular shaft 24, which is carried by base plate 58 coaxially with relative axis 67, and houses in sliding manner relative rod 57 and relative head 27 for activating relative articulated quadrilateral 35 and relative wings 36.

In each supporting unit 54, the outer end of tubular shaft 19, to which the two diametrically opposite jaws 44 are hinged externally, is fitted, by means of a sleeve 69 fitted in rotary manner to tubular shaft 19, with a plate 70 perpendicular to relative axis 21 and supporting two parallel, outward-facing lugs 71, which define a seat for receiving a respective base plate 58 of a respective gripping unit 55, and have, along their outer periphery, respective pairs of recesses 72 which are engaged by respective end portions 62 of pins 61 of respective gripping unit 55.

In actual use, as shown in FIG. 4, gripping units 55 are fed successively to input station 8 in the closed position, and with axes 38 crosswise to travelling direction 22, while, as stated, supporting units 54 are fed to input station 8 in time with relative gripping units 55, and with respective tubular shafts 1.9 so oriented angularly as to keep relative pairs of jaws 44 in the open position and in respective planes parallel to axis 5.

In the following description, reference is made to one gripping unit 55, as of the instant in which gripping unit 55 engages relative supporting unit 54 at input station 8, and is positioned with base plate 58 between lugs 71 of relative supporting unit 54, and with end portions 62 of relative pins 61 engaging relative recesses 72, to define, together with relative supporting unit 54, a relative gripping head 6.

At this point, gripping unit 55 begins interacting with supporting unit 54 by rod 56 of supporting unit 54, formerly in a withdrawn rest position, moving into an extracted work position in which rod 56 acts on rod 57 to rotate wings 36 outwards about respective axes 38. Immediately afterwards, gripping unit 55 receives relative packet 7, which is fed to input station 8 in feed direction 46, with its front major lateral wall 11 facing seat 43, with outer longitudinal tabs 17 in the open position, and with longitudinal axis 10 crosswise to travelling direction 22.

As front major lateral wall 11 of packet 7 contacts plate 25, and outer longitudinal tabs 17 contact wings 36 maintained in the open position, jaws 44 are closed to engage the ends of packet 7 and hold packet 7 on plate 25 by means of teeth 45. In other words, at input station 8 and, as explained later on, for a few moments after, supporting unit 54 and relative gripping unit 55 interact so that, as of input station 8, conveyance of packet 7 by conveyor 53 is assured, not by relative gripping unit 55, but by relative supporting unit 54, the jaws 44 of which grip the ends of packet 7 to secure it to relative gripping unit 55.

On leaving input station 8, gripping unit 55 and relative packet 7 move on, together with relative supporting unit 54, to turn-around station 47 where tubular shaft 19 is rotated 90° about axis 21. The rotation of tubular shaft 19 is transmitted by jaws 44 to tubular shaft 24 of gripping unit 55 via packet 7, and produces a 90° rotation of tubular shaft 24 about relative axis 67 coincident with relative axis 21, so that axes 38 are eventually positioned longitudinally, i.e., parallel to travelling direction 22.

Immediately afterwards, gripping unit 55 and relative packet 7 are fed, together with relative supporting unit 54, through gumming station 48 where outer longitudinal tabs 17, still in the open position on relative wings 36, are gummed and then closed by moving rod 56 into the withdrawn rest position at folding station 51.

As they close wings 36 on the one hand complete closure of packet 7, and, on the other, secure packet 7 firmly to gripping unit 55 by teeth 37 of wings 36 engaging rear major lateral wall 12 of packet 7 to hold packet 7 on plate 25.

Despite packet 7, at this point, being retained inside seat 43 by retaining means (teeth 37) on relative gripping unit 55, jaws 44 are kept in the closed position to transmit to seat 43, at further turn-around station 52, a further 90° rotation in the opposite direction to that performed at turn-around station 47. Which further rotation is performed by rotating tubular shaft 19 of relative supporting unit 54 through 90° about relative axis 21, so that packet 7 is restored to its original position crosswise with respect to travelling direction 22.

At this point, jaws 44 are opened to cut off interaction between gripping unit 55 and relative supporting unit 54; and gripping unit 55, together with relative packet 7, leaves output wheel 3 at output station 9 and continues together with conveyor 53.

What is claimed is:

1. A cigarette packing machine, the machine (1) comprising an output wheel (3), in turn comprising an input station (8) and an output station (9), and said output wheel (3) rotating about a respective axis (5) to feed a number of gripping heads (6; 54, 55) in a given travelling direction (22) and along a given path (P) through said input station (8) and said output station (9); each said gripping head (6; 54, 55) being engaged by a respective packet (7) of cigarettes having a longitudinal axis (10) and longitudinal minor lateral walls (13), each of which is defined by a respective outer longitudinal tab (17) and a respective inner longitudinal tab (16); said output wheel (3) receiving each said packet (7) at said input station (8) with the relative said outer longitudinal tabs (17) in an open position; each said gripping head (6; 54, 55) comprising folding means (36) for folding each said outer longitudinal tab (17) into a closed position contacting the relative inner longitudinal tab (16); the machine being characterized in that, in use, each outer longitudinal tab has gum applied thereto at a gumming station downstream of said input station and is folded at a folding station (51) located along said path (P) downstream of said input station.

2. A machine as claimed in claim 1 wherein the gumming station (48) is located along said path (P) and in turn comprises gumming means (49, 50) for feeding gum (18) between each said outer longitudinal tab (17) and the relative said inner longitudinal tab (16).

3. A machine as claimed in claim 2 wherein said folding means (36) comprise two folding members (36) for folding said outer longitudinal tabs (17); each said folding member (36) being movable between an open position and a closed position; and each said gripping head (6; 54, 55) comprising actuating means (26, 27, 35) for moving the relative said folding members (36) between said open and said closed position.

4. A machine as claimed in claim 2 wherein each said gripping head (6; 54, 55) also comprises first retaining means (44, 45) for securing a relative said packet (7) to the relative said gripping head (6; 54, 55) when said folding members (36) are in the open position.

5. A machine as claimed in claim 4 wherein each said packet comprises two end walls (14, 15); said first retaining means (44, 45) engaging the relative said packet (7) by said end walls (14, 15).

6. A machine as claimed in claim 2 and comprising second retaining means (37) for laterally engaging the relative said packet (7) to secure the packet (7) to the relative said gripping head (6; 54, 55).

7. A machine as claimed in claim 6 wherein said second retaining means (37) are carried by said folding means (36) and are movable with the folding means (36).

8. A machine as claimed in claim 2 wherein each said gripping head (6; 54, 55) receives each said packet (7) at said input station (8) with the relative said longitudinal axis (10) crosswise to said travelling direction (22), and comprises rotation means (19) for rotating each packet (7) 90°, about a respective axis of rotation (21; 21, 67) extending radially with respect to said path (P), at a first turn-around station (47) located upstream from said gumming station (48), so that the packet (7) is fed through said gumming station (48) with the relative said outer longitudinal tabs (17) parallel to said travelling direction (22).

9. A machine as claimed in claim 8 wherein said rotation means (19) impart to the relative said packet (7) a further 90° rotation about said axis of rotation (21; 21, 67) at a second turn-around station (52) located along said path (P) and downstream from said gumming station (48), so that the packet (7) is again positioned with the relative said longitudinal axis (10) crosswise to said travelling direction (22).

10. A machine as claimed in claim 2 and comprising a conveyor (53) for conveying said packets (7); said output wheel (3) successively releasing said packets (7) onto said conveyor (53) at said output station (9).

11. A machine as claimed in claim 10 wherein said output wheel (3) defines a drive pulley for driving said conveyor (53), and is connected to said conveyor (53) along said path (P).

12. A machine as claimed in claim 10 wherein each said gripping head (54,55) comprises a supporting unit (54) carried by said output wheel (3), and a gripping unit (55) carried by said conveyor (53); each said supporting unit (54) cooperating and interacting, in use, with a respective said gripping unit (55) along said path (P).

13. A machine as claimed in claim 12 wherein each said supporting unit (54) comprises rotation means (19) for rotating each packet (7) in 90° steps, about a respective axis of rotation (21, 67) extending radially with respect to said path (P), at a first and a second turn-around station (47, 52) located along said path (P) and on opposite sides of said gumming station (48); and first retaining means (44, 45) cooperating with the ends of the relative said packet (7) to secure the packet (7) to the relative said gripping unit (55) along said path (P).

14. A machine as claimed in claim 13 wherein each said supporting unit (54) comprises an end plate (70) perpendicular to the relative said axis of rotation (21) and carried by said rotation means (19); and each said gripping unit (55) comprises a base plate (58) connected, releasably and along said path (P), to a relative said end plate (70) seas to move along said path (P) together with the relative said supporting unit (54); each said gripping unit (55) comprising a seat (43) for receiving a relative said packet (7), and which is connected in rotary manner to the relative said base plate (58) to rotate, with respect to the base plate (58), about a respective axis (67) perpendicular to the relative base plate (58) and coincident with said axis of rotation (21), as said gripping unit (55) travels, in use, along said path (P).

15. A machine as claimed in claim 13 wherein each said supporting unit (54) interacts with the relative said gripping unit (55) at least at said input station (8) and said turn-around stations (47, 52).

16. A machine as claimed in claim 12 wherein each said gripping unit (55) comprises relative said folding means (36) and second retaining means (37) cooperating laterally with the relative said packet (7) to secure the packet (7) to the relative said gripping unit (55).

17. A machine as claimed in claim 16, wherein said second retaining means (37) are carried by said folding means (36) and are movable with the folding means (36).

18. A cigarette packing machine, the machine comprising an output wheel, in turn comprising an input station and an output station, and said output wheel rotating about a respective axis to feed a number of gripping heads in a given travelling direction and along a given path (P) through said input station and said output station; each said gripping head being engaged by a respective packet of cigarettes having a longitudinal axis and longitudinal minor lateral walls, each of which is defined by a respective outer longitudinal tab and a respective inner longitudinal tab; said output wheel receiving each said packet at said input station with the relative said outer longitudinal tabs in an open position; each said gripping head comprising folding means for folding each said outer longitudinal tab into a closed position contacting the relative inner longitudinal tab; the machine being characterized in that, in use, each outer longitudinal tab is folded at a folding station located along said path (P) downstream of said input station and comprising a gumming station located along said path and in turn comprising gumming means for feeding gum between each said outer longitudinal tab and the relative said inner longitudinal tab, wherein each said gripping head receives each said packet at said input station with the relative said longitudinal axis crosswise to said travelling direction, and comprises rotation means for rotating each packet 90°, about a respective axis of rotation extending radially with respect to said path, at a first turn-around station located upstream from said gumming station, so that the packet is fed through said gumming station with the relative said outer longitudinal tabs parallel to said travelling direction.

19. A cigarette packing machine, comprising:

an output wheel having a number of gripping heads that travel along a given path (P) through an input station to receive a packet of cigarettes with outer longitudinal tabs in an open position;

a first turn station located along path (P) downstream of the input station to turn the packet of cigarettes 90 degrees with the longitudinal tabs in the open position;

a gumming station located along path (P) downstream of the first turn station to apply gum onto the outer longitudinal tabs while the packet of cigarettes is rotated 90 degrees with respect to a packet of cigarettes at the input station; and a folding station located along path (P) downstream of the gumming station to fold the outer longitudinal tabs of the packet of cigarettes.

* * * * *

UNITED STATES PATENT AND TRADEMARK OFFICE

CERTIFICATE OF CORRECTION

PATENT NO. : 6,789,370 B2
DATED : September 14, 2004
INVENTOR(S) : Mario Spatafora It is certified that error appears in the above-identified patent and that said Letters Patent is hereby corrected as shown below:

Title page,
Item [73], Assignee, "Bolgna" should be -- Bolonga --

Column 7,
Line 35, "seas" should be -- so as --

Signed and Sealed this

Twenty-second Day of February, 2005

JON W. DUDAS
*Director of the United States Patent and Trademark Office*

UNITED STATES PATENT AND TRADEMARK OFFICE

CERTIFICATE OF CORRECTION

PATENT NO. : 6,789,370 B2 
APPLICATION NO.: 10/320289
DATED : September 14, 2004
INVENTOR(S) : Mario Spatafora It is certified that error appears in the above-identified patent and that said Letters Patent is hereby corrected as shown below:

Title page,
Item [73], Assignee, "Bolgna" should be -- Bologna --

Column 7,
Line 35, "seas" should be -- so as --

This certificate supersedes the Certificate of Correction issued February 22, 2005.

Signed and Sealed this

Sixth Day of May, 2008

JON W. DUDAS
*Director of the United States Patent and Trademark Office*